US005184332A

United States Patent [19]

Butler

[11] Patent Number: 5,184,332

[45] Date of Patent: Feb. 2, 1993

[54] MULTIPORT UNDERWATER SOUND TRANSDUCER

[75] Inventor: John L. Butler, Marshfield, Mass.

[73] Assignee: Image Acoustics, Inc., Cohasset, Mass.

[21] Appl. No.: 623,342

[22] Filed: Dec. 6, 1990

[51] Int. Cl.[5] ..... H04R 17/00

[52] U.S. Cl. ..... 367/162; 367/163; 367/174; 367/176; 310/337; 181/160; 181/182

[58] Field of Search ..... 367/162, 176, 166, 171, 367/163, 174; 310/337, 334; 181/182, 160

[56] References Cited

U.S. PATENT DOCUMENTS 3,562,451 2/1971 Mullen, Jr. ..... 381/169
4,413,198 11/1983 Bost ..... 310/324
4,549,631 10/1985 Bose ..... 181/155
4,628,528 12/1986 Bose et al. ..... 181/145
4,821,244 4/1989 Wood ..... 367/159

*Primary Examiner*—J. Woodrow Eldred
*Attorney, Agent, or Firm*—Wolf, Greenfield & Sacks

[57] ABSTRACT

A multiport underwater sound transducer including a hollow resilient housing enclosing a volume with at least two ported resonant chambers and a transduction driver disposed within the volume with opposite sides of the driver driving the two chambers. The two ports are set to resonate at slightly different frequencies and the tranducer proudces an additive output at frequencies between the two slightly different frequencies due to phase reversals of oppositely phased sound waves.

57 Claims, 10 Drawing Sheets

MULTIPORT UNDERWATER SOUND TRANSDUCER

BACKGROUND OF THE INVENTION

1. Field of the Invention

The present invention relates in general to a multiport underwater sound transducer and pertains, more particularly, to a transducer which utilizes multiple ported resonant chambers located on opposite sides of a driver and in which the ports resonate at two different frequencies and produce an additive output at frequencies between the resonant frequencies.

2. Background Discussion

Multiple ported loudspeaker systems for air transducers have been described previously, most notably in U.S. Pat. No. 4,549,631, by Amar G. Bose. In Bose's invention, the front and back surfaces of the loudspeaker drive two separate subchambers which are ported via tubes to the region outside the rectangular enclosure. Each chamber-port combination forms a Helmholtz resonator for the purpose of acoustic radiation. The Helmholtz resonances of these chambers are set to different frequencies yielding a nearly uniform response between the two resonances.

Helmholtz resonators are well-known in the prior art of both electroacoustic transducers (see U.S. Pat. No. 1,869,178, to A. L. Thuras, for "Translating Device", issued Jul. 26, 1932) and acoustics in general. The most simple example of a Helmholtz resonator is observed by blowing across the spout of a wine or soda bottle and hearing a tone. (For theory and other examples, see the following references: U.S. Pat. Nos: 1,969,704 and 4,628,528).

U.S. Pat. No. 1,969,704, entitled "Acoustic Device", issued Aug. 7, 1934 by A. D'Alton reveals a dual chamber, multiple tube invention with loudspeaker system response curves and precedes the patent of Bose by 41 years. The Bose patent, filed Oct. 23, 1983, does not reference a possibly related acoustic wave guide transmission patent, U.S. Pat. No. 4,628,528, filed earlier on Sep. 29, 1982 also by Bose (and Short), where a possible underwater sound application is noted.

The D'Alton invention teaches the use of multiple tubes or ports. Similarly, the Bose invention employs tubes through which the subchambers communicate to the region outside the rectangular enclosure. In addition, both loudspeaker systems do not provide for underwater sound transduction.

U.S. Pat. No. 4,413,198, entitled "Piezoelectric Transducer Apparatus", issued Nov. 1, 1983 by Jonathon R. Bost reveals a dual resonant chamber loudspeaker in which the chambers are driven by opposite sides of a piezoelectric driver. While this design provides for a broadened frequency response, relative to previous designs, there exists no underwater capacity. In addition, this loudspeaker is limited in frequency response due to relying on opposite sides of one driver to drive the chambers.

Accordingly, it is an object of the present invention to provide an improved sound transducer which can effectively operate underwater.

A further object of the present invention is to provide a multiport underwater sound transducer in which the need for using tubes to port the chambers is relieved.

Another object of the present invention is to provide an improved sound transducer which yields a smooth response.

Another object of the present invention is to provide an improved sound transducer which utilizes multiple ports with Helmholtz resonances set to different frequencies yielding an additive output response between the two resonant frequencies.

Another object of the present invention is to provide an improved sound transducer which employs separate drivers to drive separate chambers for a broad frequency response.

SUMMARY OF THE INVENTION

To accomplish the foregoing and other objects, features and advantages of the invention, there is provided an underwater sound transducer which is adapted to provide a uniform response and an additive output at frequencies between the two resonant frequencies of the ported chambers. The transducer of the present invention comprises a hollow, housing enclosing a volume including at least two resonant chambers, a vibrating member means having a first and second surface disposed within the housing which a least partially defines the resonant chambers, and a first and second resonating means which respectively couple the first and second resonant chambers to the water outside the resilient housing. The first surface of the vibrating member means contacts the first resonant chamber while the second surface contacts the second resonant chamber. The first and second resonating means are set to resonate at slightly different frequencies and produce an additive output at frequencies between the slightly different frequencies.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION OF THE PREFERRED EMBODIMENT

The present invention relates to an underwater transducer structure which utilizes two or more ports located on opposite sides of a driver and a transducer system with separate but close Helmholtz chambers operated by phase reversed drivers. The driver may be electroacoustic, electro-mechanic, hydro-acoustic or electro-hydraulic transducers, which include piezoelectric, magnetostrictive, variable reluctance and electrodynamic underwater devices. The external structure of the transducer is preferred, but not limited to, a cylindrical design. The ports resonate at two different frequencies and produce an additive output at frequencies between the two resonant frequencies. The additive output is a result of two 180° phase reversals, the first being the opposite phase of the two vibrating surfaces, and the second being the 180° phase reversal of the ported resonators at frequencies between the two resonances. The phase shift in the region between the two resonances is a result of the lower resonance system operating above resonance in the mass controlled region and the upper resonance system operating below resonance in the stiffness controlled region. This advantageous response is achieved quite simply with the present invention. The driver may be operated below, at or above its natural resonant frequency.

The ports may be in the form of slots, holes or tubes. Increased tube length reduces the resonant frequency of the port. A tube, however, is not absolutely necessary since there is mass within the port due to the finite thickness of the wall in which the port is cut and also the ever present radiation mass provided by the external medium. Not requiring the use of tubes as ports is another advantage of the present invention.

Figure 4A:
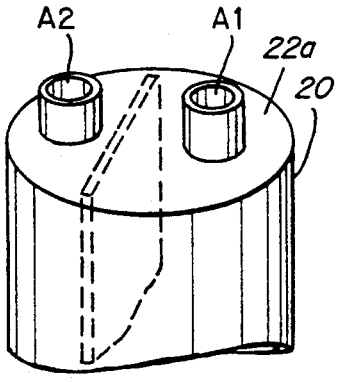
FIG. 4*a* illustrates the use of tubes as resonators.
Figure 4B:
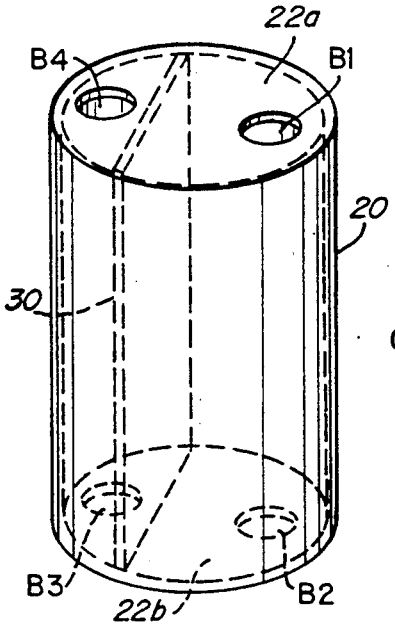
FIG. 4*b* illustrates the use of holes as resonators.
Figure 5:
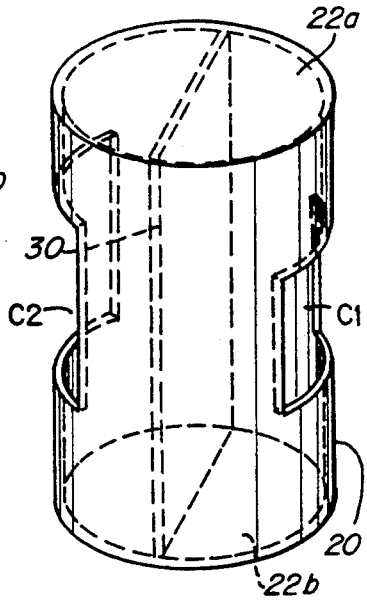
FIG. 5 illustrates the use of slots in the housing as resonators.
Figure 14:
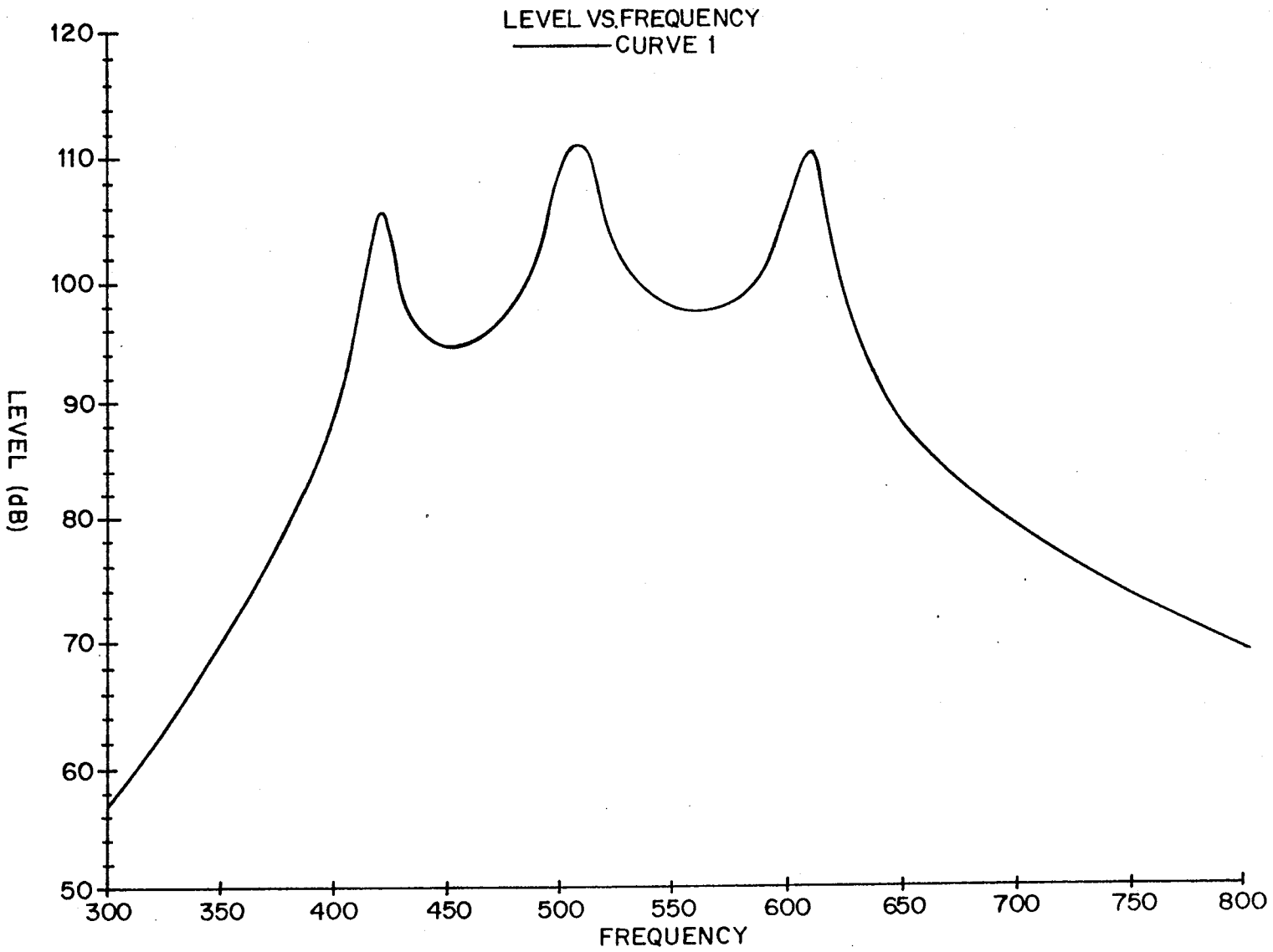
FIG. 14 illustrates the combined transmitting response curve resulting from the radiation from ports A and B of FIG. 1.
Figure 15:
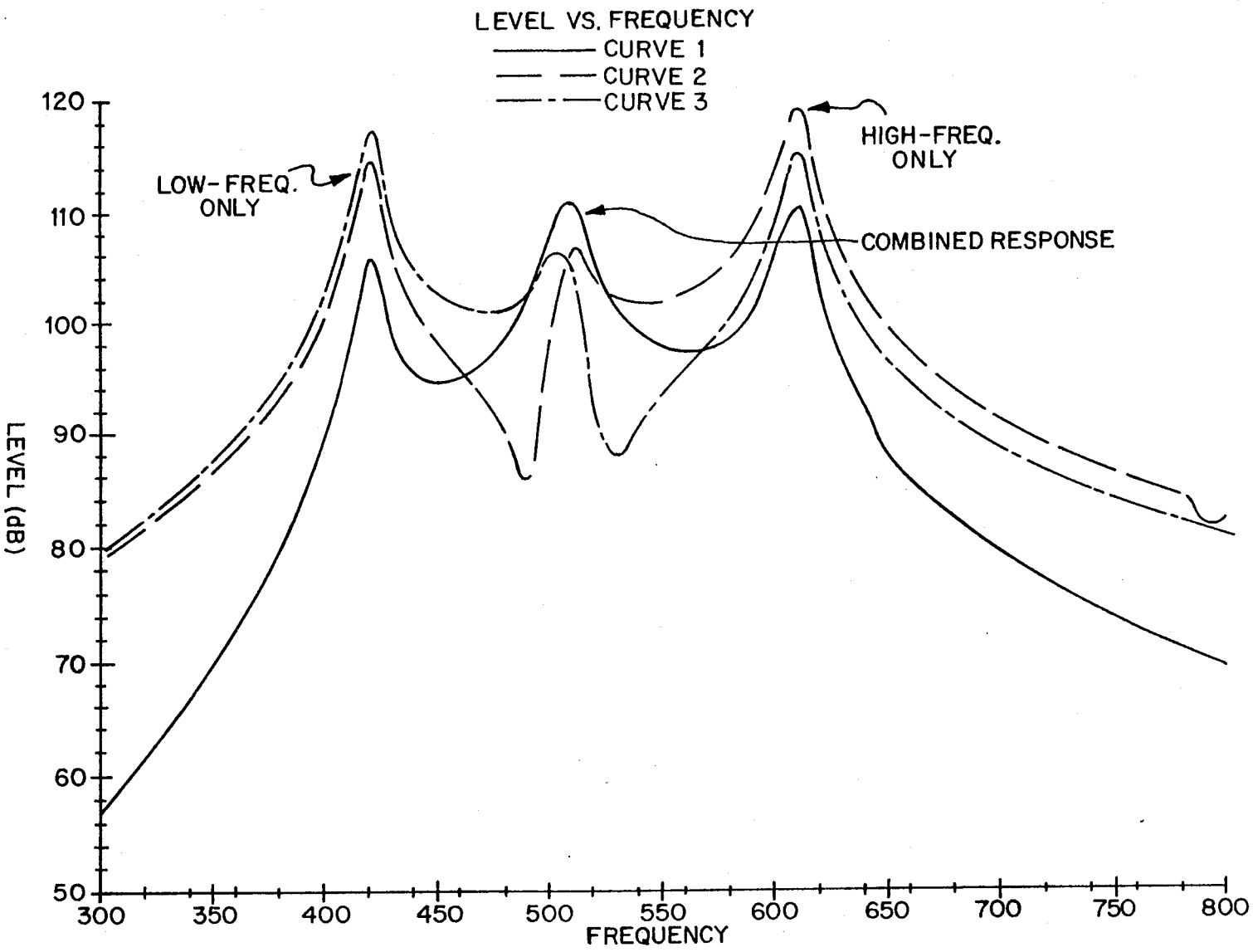
FIG. 15 illustrates the combined response along with the individual outputs from the low frequency and high frequency Helmholtz resonators.

Referring now to the FIGS., FIG. 1 illustrates a preferred embodiment of the present invention while FIGS. 2, 3, 6, 7, 8, 10, 11, 12 and 13 illustrate alternative embodiments of the present invention employing different drivers, chambers and housing arrangements. FIGS. 4 and 5 illustrate the use of holes, tubes or slots as ports. FIG. 9 illustrates an equivalent circuit to the transducer. FIGS. 14 and 15 illustrate a graph of the frequency response of the device.

Figure 1A:
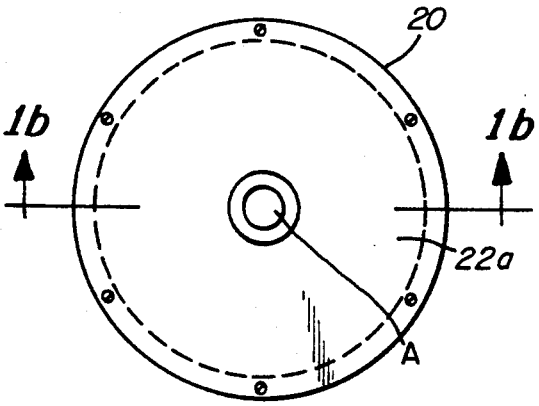
FIG. 1*a* illustrates a top view of a dual chamber underwater sound transducer with a cylindrical housing.
Figure 1B:
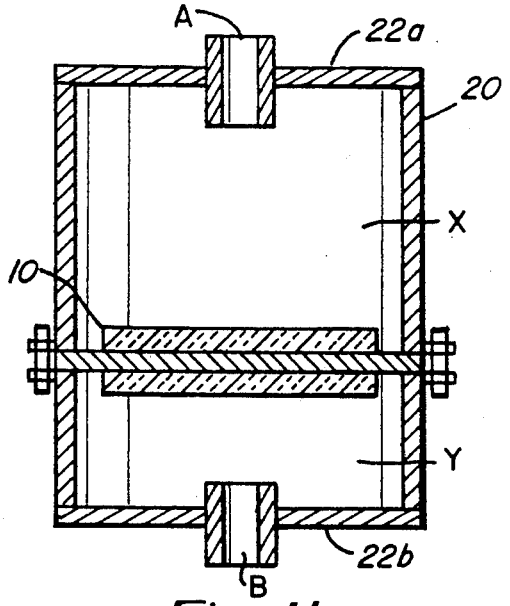
FIG. 1*b* is a cross-sectional view of a dual chamber underwater sound transducer taken along line S—S of FIG. 1*a;*

A preferred embodiment of the present invention is shown in FIGS. 1*a* and 1*b*. Referring to FIG. 1*b*, the underwater sound transducer is shown in a cross-sectional view having a hollow cylindrical housing 20 enclosing a volume with two chambers X and Y, a transduction driver 10 disposed within the volume and partially defining the bounding between the chambers X and Y, and two resonating ports A and B which respectively couple the chambers X and Y to the water medium outside the cylindrical housing 20. The cylindrical housing 20 has end walls 22*a* and 22*b* where the ports A and B are respectively located. These ports A and are part of the Helmholtz resonators. The resonant frequency of a Helmholtz resonator may be altered by changing the length of a tube inserted into the port.

When the tube is removed, there still exists a Helmholtz resonance due to the finite depth of the port cut into the housing as well as the resulting radiation mass lodging which yields an effective additional length approximately equal to 0.6 R where R is the radius of the port.

The device generally operates in the following manner: the driver 10 vibrates with opposite sides of the driver 10 driving the chambers X and Y, each port A and B then conventionally resonate at pre-tuned slightly different frequencies, and an additive output is produced at frequencies between the two slightly different frequencies. The ports act to reverse the phase of the already oppositely phased sound waves in the two respective chambers producing the additive output. Thus, it is important that opposite sides of the driver contact different chambers sending oppositely phased signals to the different chambers.

With the ports located on opposite sides of the housing, the additional pressure will provide optimal enhancement in a plane equidistant between the ports. The oppositely located ports prevent unbalanced acoustic forces from being generated at the central sum frequencies. This balance is important in underwater sound operation where the water mass and reaction forces are much greater than in air operated transducers, where the air forces are comparitively small.

The transduction driver 10 may be, for example, in the form of a bilaminar or trilaminar piezoelectric bender, a piezoelectric cylinder or a flextensional transducer. The piezoelectric driver may be operated in the 33 or 31 electromechanical modes of vibration. They may also be operated in the mechanical extensional or the inextensional bending modes as a result of the drive and mounting configuration. Plates, bars and cylinders may be employed and operate in either the doubly supported bending mode or the singly supported cantiliver mode of vibration. A bender disc type driver is illustrated in FIG. 1*b*. Referring to FIG. 1*b*, two piezoelectric discs 10 are shown reverse wired so that one expands while the other contracts causing bending. An encapsulant E is used to electrically insulate the piezoelectric driver from the water flooding medium, as shown in FIG. 2*d*. To prevent air bubble entrapment, the housing 20 of FIG. 1*b* may utilize very small holes to allow bubbles to escape (but small enough not to let the acoustic energy escape). The cylindrical housing 20 is made stiff to contain the compression and heavy enough so that the driver may bend without moving the housing. Sound is emitted from ports A and B. Each Helmholtz resonance is determined by the port length and area and also the enclosed volume. In FIG. 1*b*, the resonant frequency of port A is lower than the resonant frequency of port B.

In the underwater environment there are two basic operating modes. In one case the water is flooded into the two chambers and the electrical surfaces and wires are insulated from the water (by use of a soft potting compound). In the other case a low conductivity fluid, such as oil, fills the chambers. The mixing of this fluid with the water is prevented by a membrane, such as rubber, or a compliantly sealed suspended piston plate located at the ports. The ports or tubes are located in opposite positions to prevent unbalanced acoustic reaction forces and also to provide a plane equidistant between the two where the acoustic pressure will constructively add. [The precise position of this plane is not crucial at very low frequencies.]

Figure 2A:
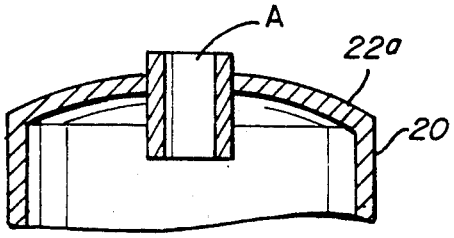
FIG. 2*a* is a cross-sectional view of the transducer taken along line S—S of FIG. 1*a* illustrating an alternative embodiment of the housing of the transducer.
Figure 2B:
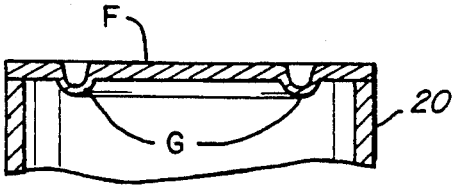
FIG. 2*b* is a cross-sectional view of the transducer taken along line S—S of FIG. 1*a* illustrating an even further embodiment of the housing of the transducer.
Figure 2C:
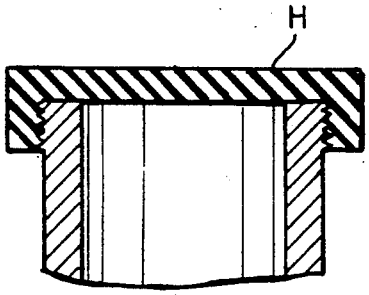
FIG. 2*c* illustrates the use of a rubber diaphragm covering a port/tube which encloses an oil filled operating version of the Helmholtz radiator.
Figure 2D:
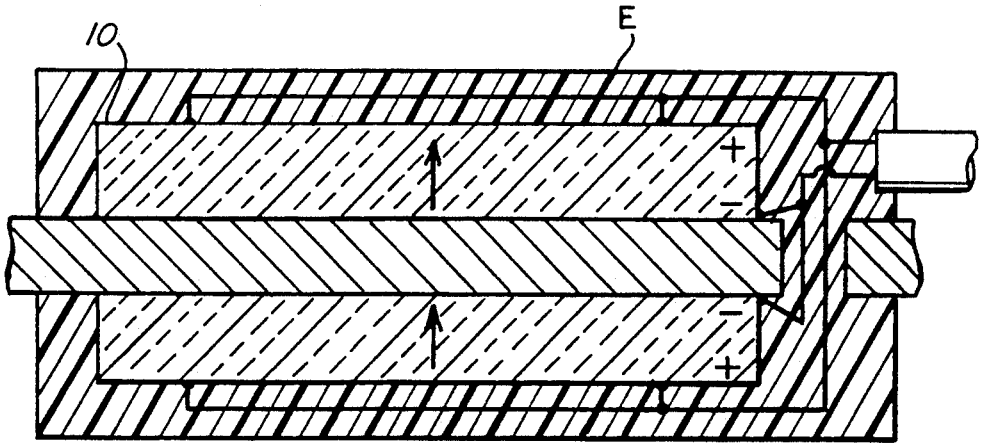
FIG. 2*d* is a close up of the driver portion of FIG. 1*b,* illustrating an alternate embodiment wiring diagram showing the direction of remnant polarization by the arrows and being enclosed by the potting or encapsulation compound for electrical insulation.

In an alternative embodiment, the end walls 22*a* and 22*b* of the cylindrical housing 20 are curved, as illustrated in FIG. 2*a*. This is done to reduce end flexing and increase the interior volume. The tube ports A and B may be adjusted to yield the desired frequency by sliding or screwing the tubes into their respective chambers or out of their respective chambers. A lower resonance is obtained with the tube extended outward to its maximum length. The port and tube may be replaced by a diaphragm, illustrated at F in FIG. 2*b*, or a membrane, illustrated at H in FIG. 2*c*. Referring to FIG. 2*b*, diaphragm F is shown suspended from a compliant suspension G with a small hole (not shown here) in the shell for fluid flooding. In this embodiment, the mass of the external diaphragm F and the compliant suspension G affect the resonance and prevent losses due to orifice flow as in the case of the ports. In an oil filled mode of operation, no small holes for fluid filling are utilized. Instead, the chambers are filled with a non-conducting fluid, such as oil, and capped with the plates F of FIG. 2*b* or membrane H of FIG. 2*c*. The electrical insulation of FIG. 2*d* is not necessarily utilized in the oil-filled mode of operation.

Figure 3A:
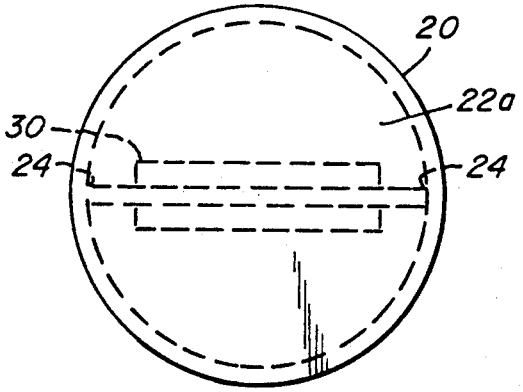
FIG. 3*a* is a top view of the transducer utilizing a piezoelectric bender bar type driver.
Figure 3B:
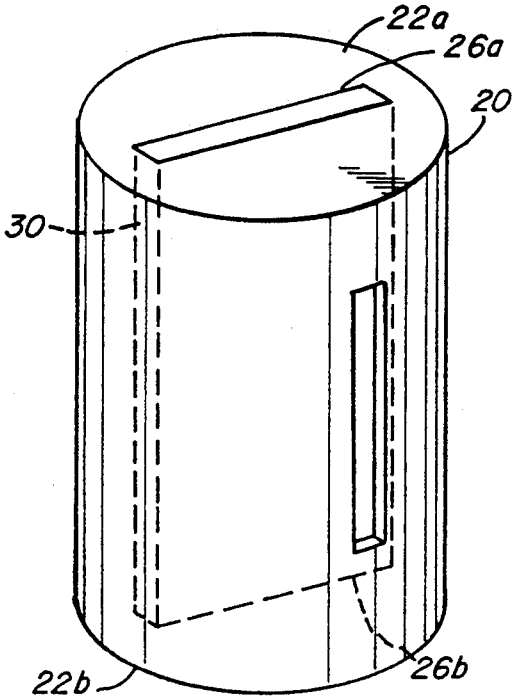
FIG. 3*b* illustrates a side view of the transducer utilizing the piezoelectric bender bar type driver.

FIGS. 3*a* and 3*b* illustrate an alternative embodiment arrangement in which a piezoelectric bender bar type driver 30 is contained within the cylinder housing 20. These bender bars 30 may be operated in the 33 or 31 modes. The bender bar 30 may be mounted on the sides as illustrated in the top view in FIG. 3*a* or, for a lower bar resonance, from the ends as illustrated in the side view in FIG. 3*b*. As illustrated in FIG. 3*a*, the side-mounted bender bar 30 is attached on both sides to the cylindrical housing 20 at reference character 24. As illustrated in FIG. 3*b*, the end-mounted bender bar 30 is attached at both ends to the end walls 22*a* and 22*b* of the housing 20 at reference character 26. A single end mounted cantiliver driver may also be utilized.

As an alternative to employing tubes as ports, slots or holes may be used to adjust the resonant frequencies. FIG. 4*a* illustrates the use of tubes A1 and A2 on the end wall 22*a* of housing 20. FIG. 4*b* illustrates the use of holes B1–B4 in the end plates 22*a* and 22*b* of housing 20. FIG. 5 illustrates the use of slots C1 and C2 with unequal slot sizes located in the sides of cylindrical housing 20.

Figure 6A:
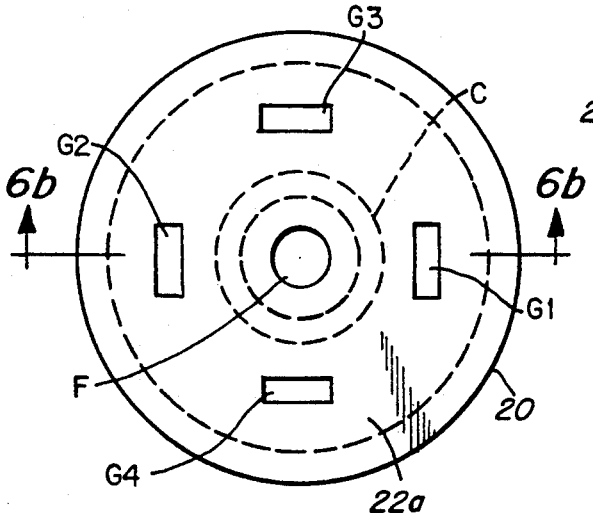
FIG. 6*a* is a top down view of an alternative embodiment of the transducer utilizing a cylindrical driver between two ported volumes.
Figure 6B:
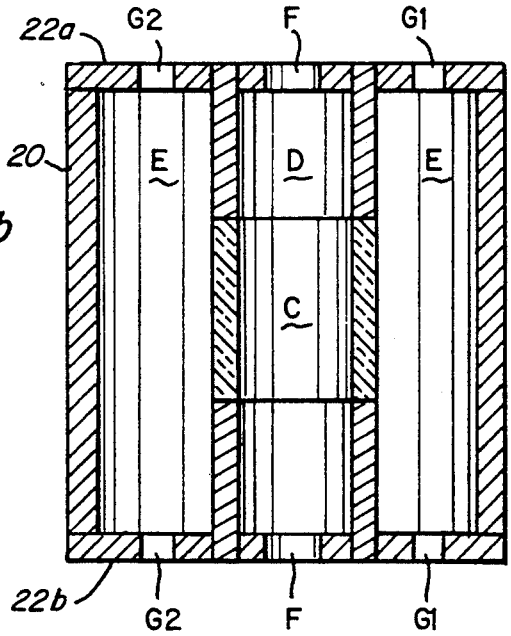
FIG. 6*b* is a cross-sectional view taken along line B—B of FIG. 6*a* illustrating an alternative embodiment of the transducer utilizing a cylindrical driver between two ported volumes.

FIGS. 6*a* and 6*b* illustrate an alternative embodiment in which cylindrical driver C is employed between the two volumes D and E with corresponding ports F and G. FIG. 6*a* illustrates a top down view while FIG. 6*b* illustrates a cross sectional side view of the alternative embodiment. As can be seen in FIGS. 6*a* and 6*b*, four ports G1–G4 are located in each end wall 22*a* and 22*b* in the outer subchamber E and one port F is located in each end wall 22*a* and 22*b* in the inner subchamber D.

Figure 7A:
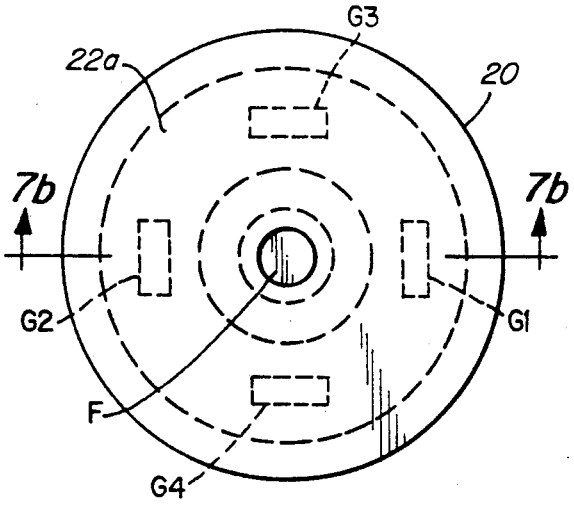
FIG. 7*a* is a top down view of a transducer in an alternative embodiment employing a more compact arrangement with asymmetrical porting.
Figure 7B:
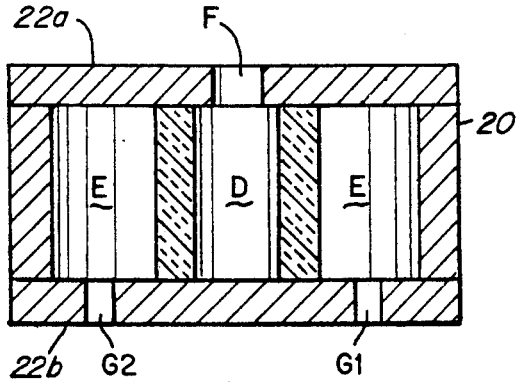
FIG. 7*b* is a cross sectional view taken along line A—A of FIG. 7*a* illustrating the transducer in an alternative embodiment utilizing a more compact arrangement with asymmetrical porting.

An alternative more compact arrangement with asymmetrical porting is illustrated in FIGS. 7*a* and 7*b*. As illustrated, the port F for inner subchamber D is located in only one end wall 22*a* and the ports G1–G4 for outer subchamber E are located only in the other end wall 22*b*. In FIG. 7*a*, end wall 22*a* is illustrated in solid lines while end wall 22*b* is illustrated in dashed lines.

Figure 8A:
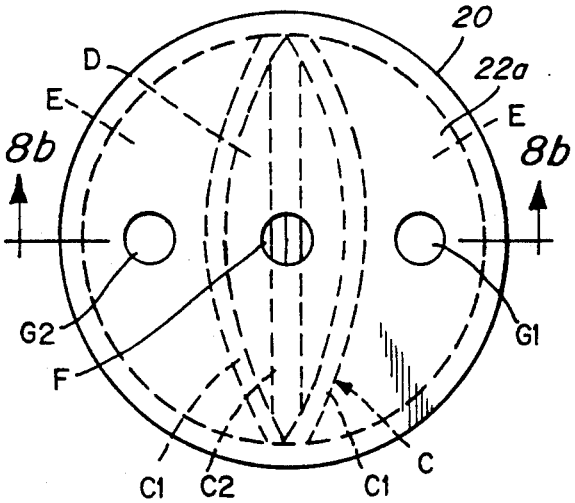
FIG. 8*a* is a top down view of a transducer in an alternative embodiment utilizing a symmetrical porting arrangement with a flextensional transducer driver.
Figure 8B:
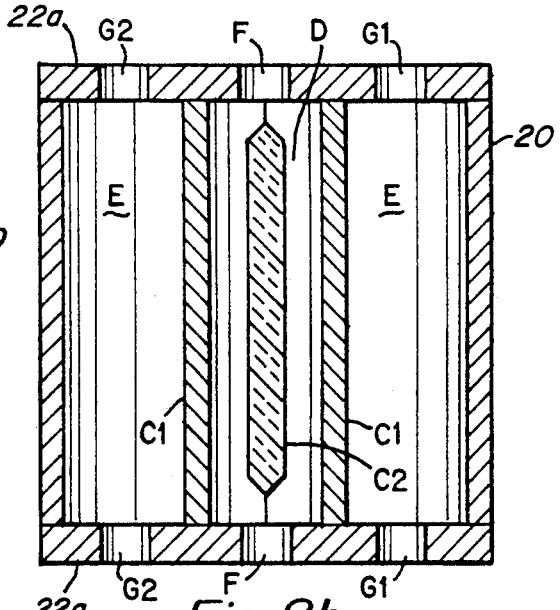
FIG. 8*b* is a cross sectional view taken along line B—B of FIG. 8*a* illustrating a transducer in an alternative embodiment utilizing a symmetrical porting arrangement with a flextensional transducer driver.
Figure 9:
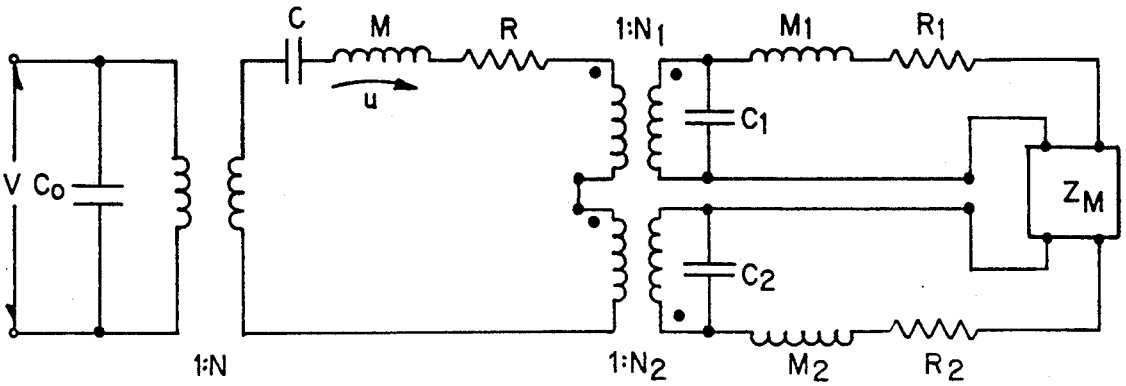
FIG. 9 is a schematic diagram of a simplified equivalent circuit for a piezoelectric driver.

A symmetrical porting arrangement with a flextensional transducer C as a driver is illustrated in FIGS. 8*a* and 8*b*. Referring to FIGS. 8*a* and 8*b*, the piezoelectric stack $C_2$ and vibrating shell $C_1$ of the flextensional transducer are shown. The ends of the shell $C_1$ may be isolated from the cylindrical container 20. Also illustrated is the outer resonant chamber E and inner resonant chamber D with respective ports G1–G2 and F.

The principles and advantages of the present invention can be better appreciated by reviewing an equivalent electronic circuit model of a transducer according to the present invention.

An example of a simplified equivalent circuit is shown in FIG. 9 for a piezoelectric driver. $C_0$ is the clamped capacity, N is the electromechanical turns ratio, C is the mechanical compliance, M is the mass and R is the loss resistance of the electro-mechanical vibrator. The two Helmholtz resonators are represented by the elements with subscripts 1 and 2. $M_x$ is the mass of the port, $C_x$ is the compliance for the enclosed respective chambers and $R_x$ represents the port loss resistance. Also shown in FIG. 9 is the self and mutual radiation coupling impedance, $Z_{mm}$, for and between the ports as well as the mechano-acoustic transformers, $N_1$ and $N_2$, between the vibrating driver surface and the fluid enclosed volume. In this circuit, the secondary side of one of the transformers is deliberately wired with opposite polarity to correctly model the opposite phase of the back surface of the driver.

Figure 10A:
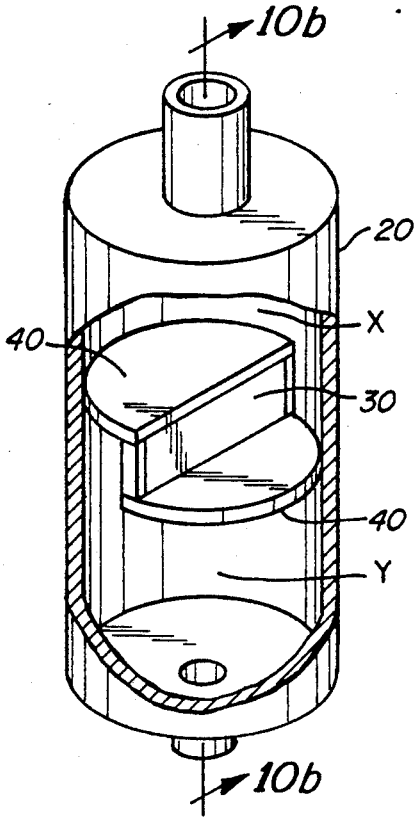
FIG. 10*a* illustrates an alternative embodiment of the transducer utilizing a piezoelectric bender driver with end side mounting and support baffles.
Figure 10B:
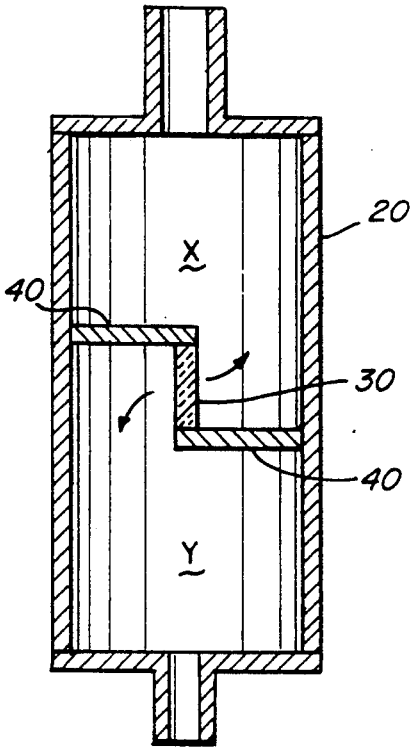
FIG. 10*b* is a cross-sectional view of FIG. 10*a* which illustrates the piezoelectric bender driver and the support baffles.

Additional embodiments of the invention are shown in FIGS. 10, 11, 12 and 13 In FIGS. 10*a* and 10*b*, there is shown a piezoelectric bender 30 with an end side mounting as in FIG. 3*a*, but now with a bender piezoelectric driver 30 that is not the full length cf the cylinder 20. In FIGS. 10*a* and 10*b*, the opposite sides of the bender are contained within their respective chambers X and Y by the two stiff baffles 40.

Figure 11:
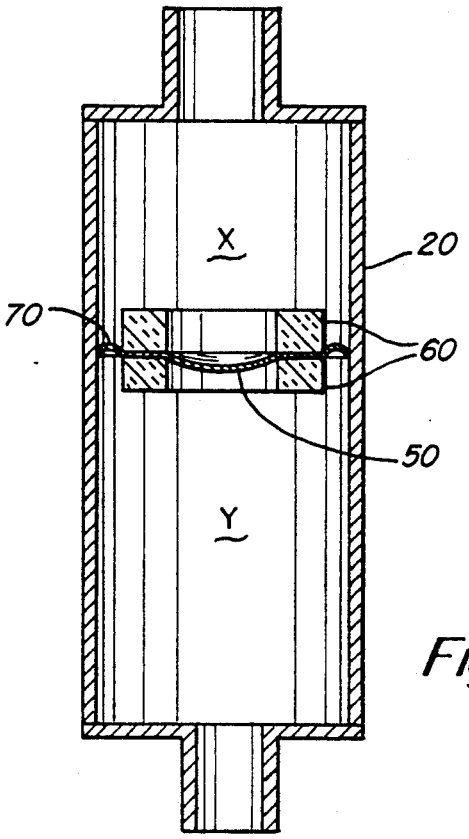
FIG. 11 illustrates an alternative embodiment of the transducer with two chambers driven by a thin, curved shell.

FIG. 11 illustrates the two chambers X and Y, driven by a thin curved shell 50, driven into a bending mode by the two piezoelectric rings 60, which operate in a radial mode. A single shell 50 of the ring shell transducer is employed here. Referring to FIG. 11, the rings 60 are shown completely within the entire housing 20 and mounted by a soft radially flexible material or structure 70. The oppositely phased motion of the ring 60 is of no importance since the inside and outside ring generated pressures cancel. The opposite sides of the curved shell 50 vibrate in phase opposition as desired and do not cancel since they are isolated by the two chambers X and Y. The gap between the ring 60 and the housing 20 is made small enough to keep the two chambers X and Y isolated.

Figure 12A:
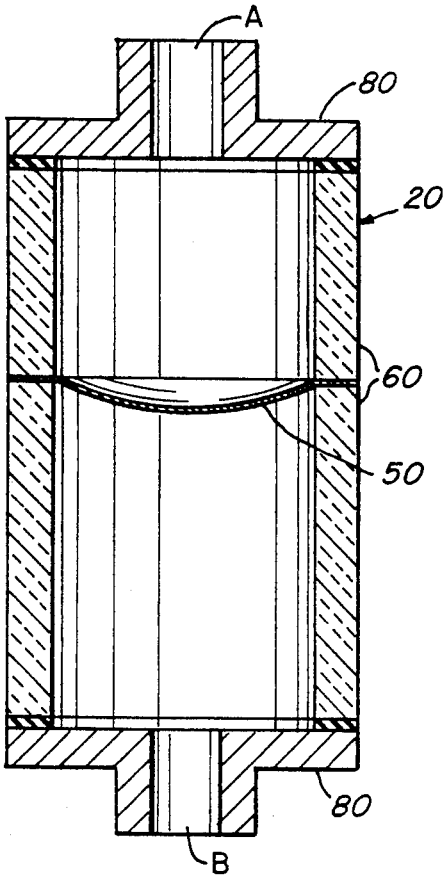
FIG. 12*a* illustrates an alternative embodiment of the transducer in which the cylindrical housing is constructed from the vibrating ring which causes the curved shell to vibrate.

As illustrated in FIG. 12*a*, the cylindrical housing 20 is constructed from the vibrating ring 60 (in total or in part) which causes the curved shell 50 to vibrate. In this embodiment, the motion of the ring 60 may cause some constructive and destructive interference. If the amplification of the shell motion is large, this effect will not be strong. In the embodiment illustrated in FIG. 12*b*, the end caps 80 and ports A and B of FIG. 12*a* are replaced by cylindrical tube extensions 90 of different length. The device has two different wave tube resonances. The cylindrical structure vibrates in a radial mode causing the curved shell to move in the axial direction.

Figure 12B:
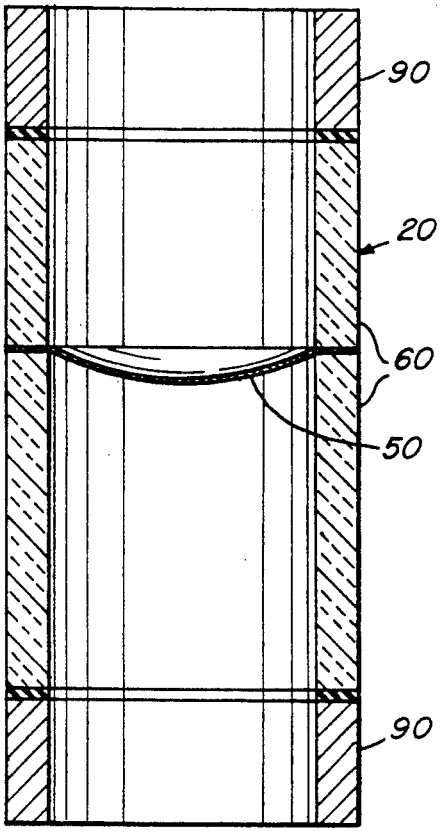
FIG. 12*b* illustrates an alternative embodiment of the transducer in which the end caps and port are replaced by cylindrical tube extensions of different lengths.
Figure 12C:
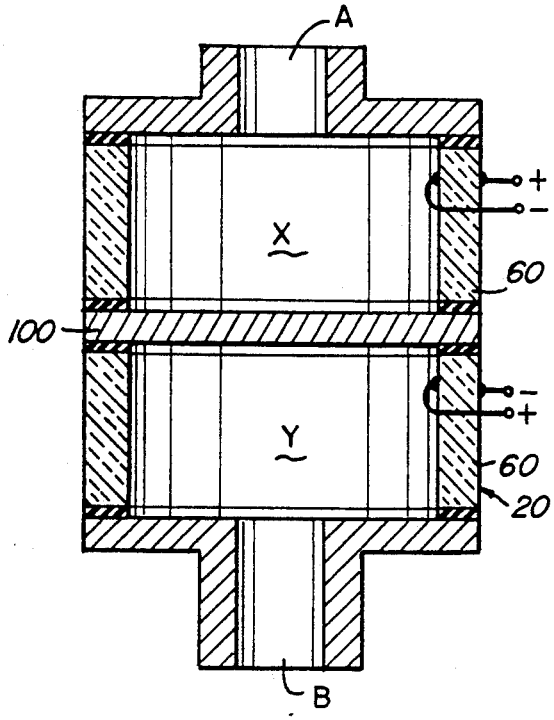
FIG. 12*c* illustrates the transducer in an alternative ring drive condition in which the chambers are separated by a rigid wall.
Figure 12D:
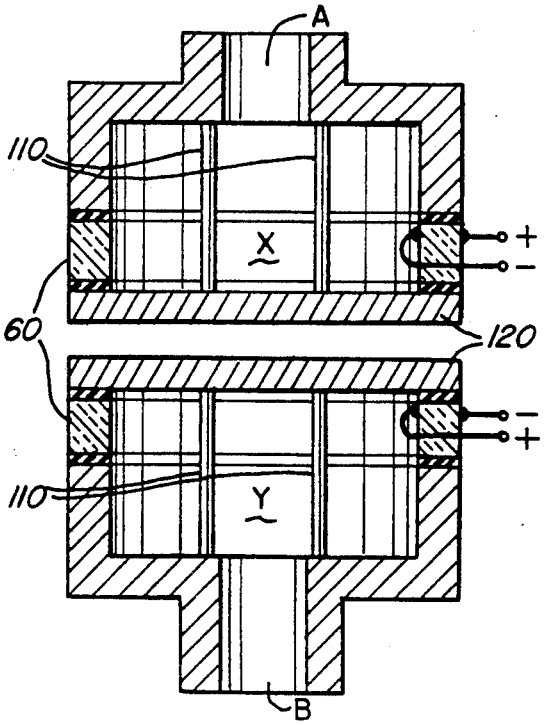
FIG. 12*d* illustrates the transducer in an alternative ring drive condition in which the chambers are separately constructed.

Two alternative ring (or cylindrical) drive conditions are shown in FIGS. 12*c* and 12*d*. In FIGS. 12*c* and 12*d* an arrangement is illustrated in which two separate drivers are utilized to drive the separate chambers. This novel and advantageous embodiment provides for a broad frequency response. The drivers are driven out of phase causing inner cancellation and producing an additive output at a frequency between the resonant frequencies. The chambers are rigidly separated. Employing a multiplicity of chambers, each driven by a different driver, where alternate drivers between successive resonances are phase reversed, results in an extended band of frequencies.

Referring to FIGS. 12*c* and 12*d*, the piezoelectric rings 60 may be driven in a 33 or 31 piezoelectric mode and used to excite the inner Helmholtz chambers X and Y in a direct manner without the use of the curved shell 50 of FIGS. 11, 12*a*, 12*b* or the configurations of FIGS. 6 and 7. Instead, the chambers X and Y are separated by a rigid wall 100 as illustrated in FIG. 12*c* or separately constructed as illustrated in FIG. 12*d*. As illustrated in FIG. 12*d*, the chambers are separated such that the separate rigid plates 120 are in close proximity to one another. Means for separating the rigid plates 120 are used. For example, a few rubber separators can be placed between the rigid plates 120 for this purpose.

FIG. 12*d* also illustrates a cylindrical housing 20 in which the ring driver 60 is only part of the cylindrical chamber construction. Referring now to FIG. 12*d*, the use of rods or bars 110 to rigidly support the plates 120 relative to the housing 20 is illustrated. In the case of both configurations, the plate or wall 120 should be designed to be rigid just as the remaining cylindrical housing 20 should be rigid. The opposite phase condition for each chamber X and Y is achieved by driving the cylinders with opposite polarity (or reversing the direction of remnant polarization).

Since the Helmholtz resonators provide a large motion amplification at the ports A and B, the radiation from the outside of the ring will be small compared to this motion. Furthermore, with both units at a small separation distance, the radiation from the outside of the rings 60 will be greatly reduced since these motions are opposite in phase causing cancellation. An extended band of frequencies results from this embodiment and a broader response may be obtained by use of a multiplicity of chambers with respective drivers phase reversed between successive resonances.

Figure 12E:
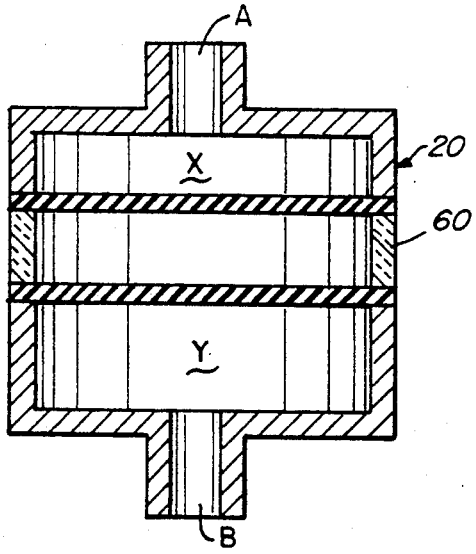
FIG. 12*e* is an alternative embodiment of the transducer in which the bending motion of the cylinder is used to cancel the outer radiation.
Figure 12F:
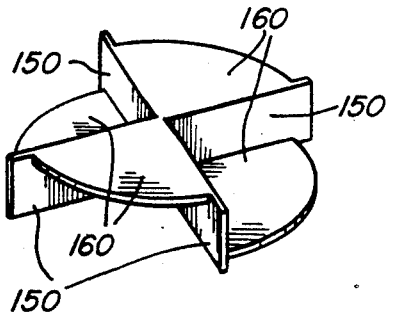
FIG. 12*f* illustrates the ring insert utilized to partition the sound so that oppositely phased sound waves appear in different quadrants.
Figure 12G:
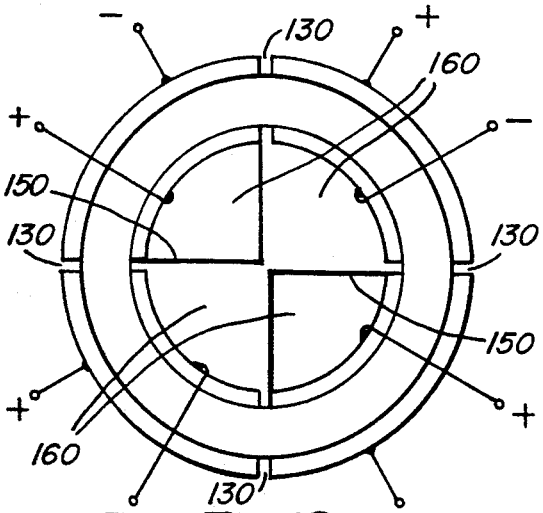
FIG. 12*g* illustrates reverse voltage on four quadrants of the piezoelectric ring.
Figure 12H:
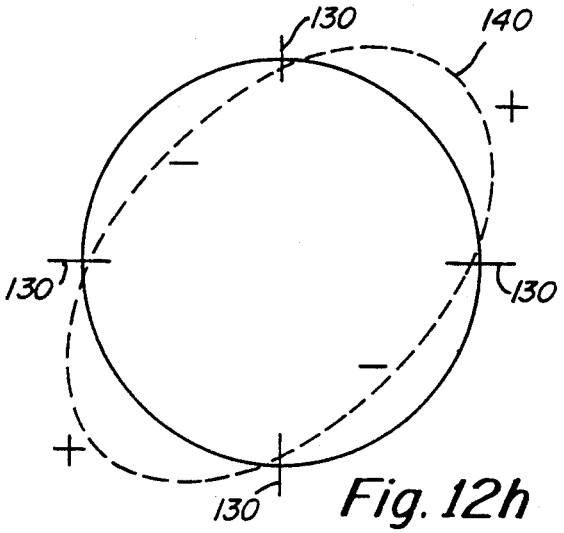
FIG. 12*h* illustrates the cylinder movement in the quadrant bending mode.

An alternative construction which provides cancelled outer radiation and utilizes the bending motion of a cylinder is shown in FIG. 12*e* along with the insert FIG. 12*f*. In this alternative embodiment, the piezoelectric ring 60 is driven into a mode of vibration in which there are four nodes 130 (see FIG. 12*g*) and the motion is opposite in direction on the sides adjacent to the nodes 130. This action may be accomplished by reversing the phase of the voltage on the four quadrants as shown in the 31 piezoelectric drive of FIG. 12*g*. (A 33 drive may also be utilized.) By itself this quadrant mode of vibration is higher in frequency than the uniform ring expansion mode. A more desirable lower frequency quadrant bending mode may be excited by rigidly attaching an additional cylinder. Such a resulting bending mode is illustrated by the dashed line 140 in FIG. 12*h*. To obtain this, an inner or outer inert (for example, metallic) cylinder, rigidly attached to the piezoelectric cylinder, would allow the bending mode to be electrically excited. Alternatively, an inner piezoelectric cylinder rigidly attached but oppositely phased from the outer cylinder at each quadrant area would also produce the same result. Since the outer motion across the nodes is oppositely phased, the outside radiation is greatly reduced. The oppositely phased surfaces of the inner motion, however, are sent to the respective Helmholtz chambers (through the ring insert shown in FIG. 12*f*) to provide the desired out of phase drive.

This lower frequency quadrant bending mode is enhanced by inserting the ring insert illustrated in FIG.

12*f*. The rigid crossed plates 150 are rigidly attached to the nodes 130 of the four quadrant ring bender. Attached to the two crossed plates 150 are two rigid quadrant baffle caps 160 on the top and two quadrant baffle caps 160 on the bottom as shown in FIG. 12*f*. These baffle caps 160 send coherent sound into the respective Helmholtz chambers with the phase of one chamber being opposite to that of the other, as desired. The quadrant baffle caps 160 may be rigidly attached to the cylindrical housing 20 of the Helmholtz chambers but separated from the piezoelectric ring 60 so as not to inhibit the ring bending motion.

Figure 12I:
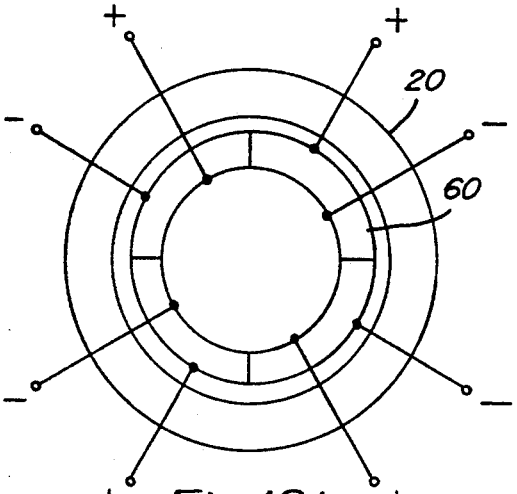
FIG. 12*i* illustrates use of the ring insert to partition the sound so that oppositely phased sound waves appear in different quadrants.
Figure 12J:
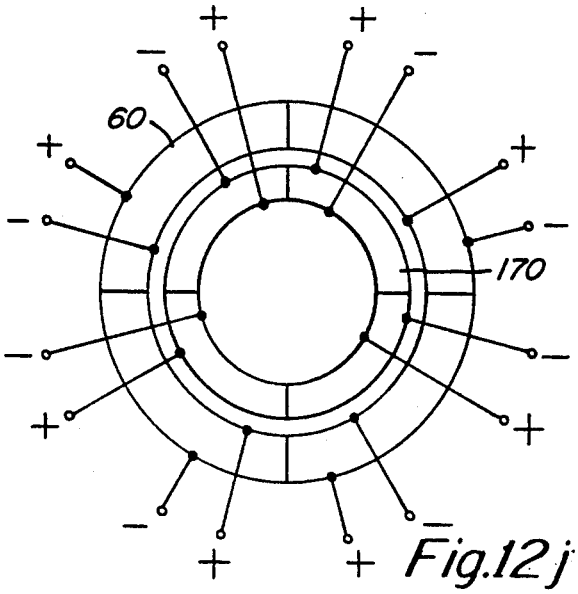
FIG. 12*j* illustrates use of the ring insert to partition the sound so that oppositely phased sound waves appear in different quadrants.

FIGS. 12*i* and 12*j* help illustrate the method for driving the transducer into the quadrant bending mode. The device in FIG. 12*i* utilizes an outer inactive cylinder 20 while the device in FIG. 12*j* utilizes an active piezoelectric outer cylinder 60 driven out of phase with the inner piezoelectric cylinder 170. Both embodiments require opposite phases on adjacent quadrants as shown.

The ring insert of FIG. 12*f* sends sound signals oppositely phased into the two Helmholtz chambers as desired. The crossed rigid plates 150 may be attached directly to the nodes 130 of the cylinder 20. The quandrant baffle caps 160 should not touch the piezoelectric cylinder 60 although the quandrant baffle caps 160 may be in rigid contact with the upper and lower Helmholtz chambers.

Figure 13A:
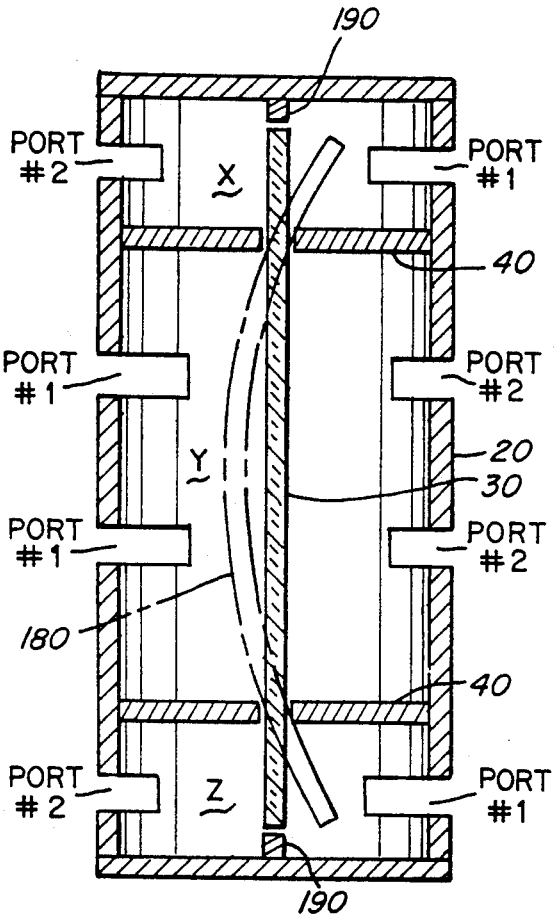
FIG. 13*a* illustrates an alternative embodiment of the transducer utilizing a multiport arrangement in which the driver is a free bending bar running along the length of the enclosing tube.
Figure 13B:
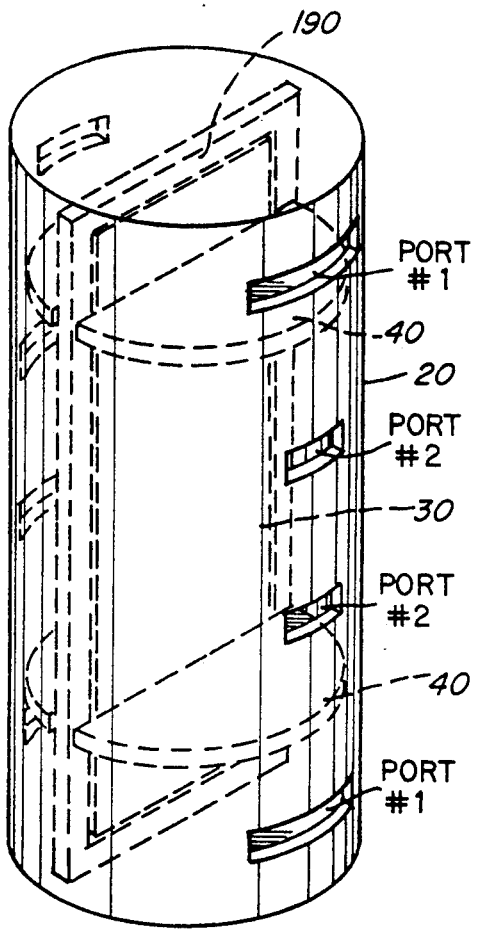
FIG. 13*b* is a side view of an alternative embodiment of the transducer utilizing a multiport arrangement in which the driver is a free bending bar running along the length of the enclosing tube.

In a further alternative embodiment in accordance with the present invention, a multiple port arrangement is shown in FIGS. 13*a* and 13*b* in which the driver is a free bending bar 30 located along the length of the cylindrical housing 20. The dashed line 180 illustrates the position of the bending bar 30 at one instant of time. Baffles 40 are located at the bar nodes to separate the cylinder into three chambers, X, Y and Z. There is also a baffle frame 190 on the edges and top of the bender to isolate the acoustic field from opposite sides of the bender 30, as illustrated in the side view of the device in FIG. 13*b*. Thus, the cylindrical housing 20 is divided into six separate chambers. The Helmholtz resonances are adjusted by altering the dimension of the ports #1 and #2. Hence, in the top and bottom chambers, X and Z, ports #1 would yield the lower frequency since they are longer than ports #2. The center chamber Y has ports #1 on the reverse side since the motion of the bar 30 is reversed there. Note that there are dual ports in chamber Y to account for the larger chamber volume. (These could be combined into one port with a large port diameter.)

The device of FIGS. 13*a* and 13*b* is more complex than the previously disclosed embodiments. It, nonetheless, has some superior design features. Since the bar 30 is free with mounting only at vibration nodes, no vibration is coupled to the housing 20 and the mechanical losses are extremely small. Moreover, the housing 20 is not set into vibration as a result of the acoustic motion in the ports because corresponding ports #2 or #1 are on opposite sides of the housing 20, resulting in no net lateral force on the housing 20. Thus, in this embodiment of the invention, the housing 20 does not experience motion due to unbalanced lateral mechanical and acoustical forces. Of course, the housing 20 can experience other forces that may cause unwanted vibration. The two cases cited above, however, are two that would otherwise need to be controlled by large masses. In this embodiment of the present invention, the control is provided by the balanced symmetry of the vibrational mechanical and acoustical system.

A device with the configuration as illustrated in FIGS. 1*a* and 1*b* has been simulated on an equivalent circuit computer program, using the circuit of FIG. 9. The piezoelectric bender 10 was set to resonate at 500 Hz and the Helmholtz resonators A and B were set to resonate at 490 and 510 Hz respectively. The cylindrical shaped volume of FIG. 1 was configured with a total approximate housing length of 20 inches and with an inside diameter of 4.5 inches. The two chamber X and Y lengths were eight and twelve inches long respectively. The port tube A and B lengths were 2.4 and 1.25 inches long respectively with respective diameters of 1.5 and 1 inches. The combined transmitting response curve resulting from the radiation from ports A and B of FIG. 1 is shown in FIG. 14. A smoother response may be obtained by adjusting the frequency location of the resonant chambers X and Y and the mechanical impedance of the electro mechanical driver 10.

FIG. 15 illustrates the combined response along with the individual outputs from the low frequency and high frequency Helmholtz resonators A and B respectively. Note that at 500 Hz the two individual outputs add (in phase) to give the combined response. The in phase addition is a result of the combination of two following phase reversals: the opposite phases (180°) of the sound waves generated by opposite sides of the disc driver and the opposite phases (180°) of the waves created by the Helmholtz resonators in the region between their resonances, yielding a total phase shift of 360° or simply 0°, i.e., no phase shift.

Please note that a magnetostrictive driver may be used in place of the piezoelectric driver in the above described embodiments of the present invention for underwater sound applications. Please also note that instead of the Helmholtz resonators being free flooded, the resonators may be oil filled with compliant mounted pistons attached to the port openings to maintain a separation between inner and outer fluids or to provide a more compliant inner fluid and a more massive port radiator.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. An underwater sound transducer comprising;

a hollow closed housing enclosing a volume including at least two resonant chambers, a vibrating member having a first surface and a second surface, said vibrating member being disposed within said housing and at least partially defining said resonant chambers with said first surface of said vibrating member facing said first resonant chamber and said second surface of said vibrating member facing said second resonant chamber, first and second resonating means for respectively coupling said first and second resonant chambers to the area outside of said housing, said first and second resonating means set to resonate at slightly different frequencies and producing an additive output at frequencies between said slightly different frequencies, in combination with a liquid environment in which the resonating means operate to direct acoustic signals into the liquid.

2. An underwater sound transducer as set forth in claim 1 wherein said vibrating member consists of a circular disc.

3. An underwater sound transducer as set forth in claim 1 wherein said vibrating member consists of a rectangular plate.

4. An underwater sound transducer as set forth in claim 1 wherein said vibrating member is substantially cylindrical in shape.

5. An underwater sound transducer as set forth in claim 1 wherein said vibrating member consists of an oval shell.

6. An underwater sound transducer as set forth in claim 1 wherein each said resonating means comprises an aperture defined in said chamber.

7. An underwater sound transducer as set forth in claim 6 wherein said aperture is in the form of a Helmholtz resonator.

8. An underwater sound transducer as set forth in claim 7 wherein said aperture is in the form of a slot.

9. An underwater sound transducer as set forth in claim 6 wherein said apertures enable coupling through of acoustical radiation.

10. An underwater sound transducer as set forth in claim 6 wherein said apertures enable coupling through of acoustical radiation.

11. An underwater sound transducer as set forth in claim 6 wherein said vibrating member having a resonant frequency, being set between said slightly different frequencies of said resonating means.

12. An underwater sound transducer as set forth in claim 11 wherein said vibrating member is operated at below said resonant frequency.

13. An underwater sound transducer as set forth in claim 11 said vibrating member is operated at above said resonant frequency.

14. An underwater sound transducer as set forth in claim 1 wherein said vibrating member consists of a driving transducer of the piezoelectric type.

15. An underwater sound transducer as set forth in claim 1 wherein said vibrating member consists of a driving transducer of the magnetostrictive type.

16. An underwater sound transducer as set forth in claim 1 wherein said vibrating member consists of a driving transducer of the electrodynamic type.

17. An underwater sound transducer as set forth in claim 1 wherein said vibrating member consists of a driving transducer of the variable reluctance type.

18. An underwater sound transducer as set forth in claim 1 wherein said vibrating member consists of a driving transducer of the hydrodynamic type.

19. An underwater sound transducer as set forth in claim 1 wherein said vibrating member consists of a driving transducer of the magnetohydrodynamic type.

20. An underwater sound transducer as set forth in claim 11 said vibrating member consists of a driving transducer of the piezoelectric type.

21. An underwater sound transducer as set forth in claim 11 wherein said vibrating member consists of a driving transducer of the magnetostrictive type.

22. An underwater sound transducer as set forth in claim 11 said vibrating member consists of a driving transducer of the electrodynamic type.

23. An underwater sound transducer as set forth in claim 11 said vibrating member consists of a driving transducer of the variable reluctance type.

24. An underwater sound transducer as set forth in claim 11 wherein said vibrating member consists of a driving transducer of the hydrodynamic type.

25. An underwater sound transducer as set forth in claim 1 wherein said vibrating member consists of an electro mechanical driver, said electro-mechanical driver including a bender bar.

26. An underwater sound transducer as set forth in claim 1 wherein said vibrating member consists of an electro-mechanical driver of the flexural type.

27. An underwater sound transducer as set forth in claim 1 wherein said vibrating member consists of an electro mechanical driver of the piston type.

28. An underwater sound transducer as set forth in claim 1 wherein said vibrating member consists of an electro-mechanical driver of the flextensional type.

29. An underwater sound transducer as set forth in claim 11 wherein said vibrating member consists of an electro mechanical driver, said electro-mechanical driver including a bender bar.

30. An underwater sound transducer as set forth in claim 11 wherein said vibrating member consists of an electro mechanical driver of the flexural type.

31. An underwater sound transducer as set forth in claim 11 said vibrating member consists of an electro-mechanical driver of the piston type.

32. An underwater sound transducer as set forth in claim 11 wherein said vibrating member consists of an electro mechanical driver of the flextensional type.

33. An underwater sound transducer comprising;

a hollow closed housing enclosing a volume including at least two resonant chambers, a vibrating member having a first surface and a second surface, said vibrating member comprised of an electro-mechanical driver and a bender bar, at least one baffle bar extending into the volume of said hollow housing for supporting at least one end of said bender bar, said vibrating member being disposed within said housing and at least partially defining said resonant chambers with said first surface of said vibrating member facing said first resonant chamber and said second surface of said vibrating member facing said second resonant chamber, first and second resonating means for respectively coupling said first and second resonant chambers to the area outside of said housing, said first and second resonating means set to resonate at slightly different frequencies and producing an additive output at frequencies between said slightly different frequencies.

34. An underwater sound transducer as set forth in claim 33 wherein said at least one baffle bar helps define a boundary between said resonant chambers within the volume of said hollow housing, for separating radiation to opposite sides of said vibrating member.

35. An underwater sound transducer as set forth in claim 33 wherein said sat least one baffle bar divides said volume into quadrant chambers, said electro-mechanical driver being a cylindrical driver operating in a quadrant bending mode of vibration.

36. An underwater sound transducer comprising;

a hollow closed, cylindrical in shape housing enclosing a volume including at least two resonant chambers, a rigid baffle disposed within said volume of said cylindrical housing partially defining two said resonant chambers, a vibrating member having a first surface and a second surface, said vibrating member comprising of two cylindrical drivers each driven oppositely in phase, said vibrating member being disposed within said housing and at least partially defining said resonant chambers with said first surface of said vibrating member facing said first resonant chamber and said second surface of said vibrating member facing said second resonant chamber, first and second resonating means for respectively coupling said first and second resonant chambers to the area outside of said housing, said first and second resonating means set to resonate at slightly different frequencies and producing an additive output at frequencies between said slightly different frequencies.

37. An underwater sound transducer comprising;

a hollow closed housing enclosing a volume including two resonant chambers, a vibrating member having a first surface and a second surface, said vibrating member being disposed within said housing and at least partially defining said resonant chambers with said first surface of said vibrating member facing said first resonant chamber and said second surface of said vibrating member facing said second resonant chamber, first and second resonating means for respectively coupling said first and second resonant chambers to the area outside of said housing, said first and second resonating means set to resonate at slightly different frequencies and producing an additive output at frequencies between said slightly different frequencies, each said resonating means comprises an aperture defined in said chamber, each of said apertures comprising of Helmholtz resonators, said resonators resonate at two different but adjacent frequencies, said vibrating member comprising of two drivers oppositely phased, for providing an additive Helmholtz port output at a frequency between said two resonator frequencies.

38. An underwater sound transducer as set forth in claim 37 wherein said Helmholtz resonators being cylindrical and said drivers being cylinder piezoelectric drivers.

39. An underwater sound transducer comprising;

a hollow closed housing enclosing a volume including at least two resonant chambers, a vibrating member having a first surface and a second surface, said vibrating member being disposed within said housing and at least partially defining said resonant chambers with said first surface of said vibrating member facing said first resonant chamber and said second surface of said vibrating member facing said second resonant chamber, first and second resonating means for respectively coupling said first and second resonant chambers to the area outside of said housing, said first and second resonating means comprise means defining at least two oppositely directed ports, said first and second resonating means set to resonate at slightly different frequencies and producing an additive output at frequencies between said slightly different frequencies.

40. An underwater sound transducer comprising:

a hollow housing enclosing volume, means disposed within said housing for separating said housing into two separate resonant chambers, at least two separate vibrating members, including means for spacedly separating said vibrating members, wherein said vibrating members separately contact said resonant chambers, at least two resonating means for respectively separately coupling said resonant chambers to the area outside of said housing, said resonating means set to separately resonate at slightly different frequencies and producing additive outputs at frequencies between said slightly different frequencies.

41. An under water sound transducer as set forth in claim 40 wherein each said resonating means comprises an aperture defined in said chamber.

42. An underwater sound transducer as set forth in claim 41 wherein said apertures enable coupling through of acoustical radiation.

43. An underwater sound transducer as set forth in claim 42 wherein said aperture is in the form of a Helmholtz resonator.

44. An underwater sound transducer as set forth in claim 43 wherein said aperture is in the form of a slot.

45. An underwater sound transducer as set forth in claim 43 wherein said aperture is in the form of a tube.

46. An underwater sound transducer as set forth in claim 49 said housing is cylindrical in shape, said means for separating comprises a rigid baffle disposed within said volume of said cylindrical housing, said at least two separate vibrating members consists of two separate cylindrical drivers, said two separate cylindrical drivers being driven oppositely in phase.

47. An underwater sound transducer as set forth in claim 1 further including means for insulating electrical components within said hollow housing from said water.

48. An underwater sound transducer as set forth in claim 47 wherein said means for insulating includes a low-conductivity fluid disposed within said resonant chambers.

49. An underwater sound transducer as set forth in claim 47 wherein said means for insulating includes a potting compound for surrounding said electric components.

50. An underwater sound transducer comprising:

a hollow cylindrical housing having two end walls and enclosing a volume including first and second resonating chambers, said second resonating chamber surrounding and concentric with said first resonating chamber;

a cylindrical driver disposed within said first resonating chamber and including surfaces which at least partially define said resonating chambers;

a plurality of second chamber Helmholtz resonating apertures within at least one end wall in said second resonating chamber, said second chamber apertures coupling said second resonating chamber o the area outside of said housing;

a first chamber Helmholtz resonating aperture within at least one end wall in said first resonating chamber, said first chamber aperture coupling said first resonating chamber to the area outside of said housing;

said first chamber aperture and second chamber apertures set to resonate at slightly different frequencies to produce an additive output at frequencies between said slightly different frequencies.

51. An underwater sound transducer as set forth in claim 50 wherein each end wall includes both said first chamber aperture and said second chamber apertures.

52. An underwater sound transducer as set forth in claim 50 wherein one of said end walls includes only said first chamber aperture and the other of said end walls includes only said second chamber apertures.

53. An underwater sound transducer comprising:

a hollow cylindrical housing having two end walls and enclosing a volume including first and second resonating chambers, said second resonating chamber surrounding and concentric with said first resonating chamber;

a flextensional transducer driver disposed within said housing and including a piezoelectric stack disposed within said first resonating chamber and a vibrating shell surrounding said piezoelectric stack and at least partially defining said resonating chambers;

a plurality of second chamber Helmholtz resonating apertures within at least one end wall in said second resonating chamber, said second chamber apertures coupling said second resonating chamber to the area outside of said housing;

a first chamber Helmholtz resonating aperture within at least one end wall in said first resonating chamber, said first chamber aperture coupling said first resonating chamber to the area outside of said housing;

said first chamber aperture and second chamber apertures set to resonate at slightly different frequencies to produce an additive output at frequencies between said slightly different frequencies.

54. An underwater sound transducer comprising:

a hollow cylindrical housing having two end walls and enclosing a volume including first and second resonating chambers;

ring shell transducer driver disposed within said housing and including two piezoelectric rings and a curved shell disposed between said rings and at least partially defining said resonating chambers, said curved shell having a first surface facing said first resonating chamber and a second surface facing said second resonating chamber;

a first Helmholtz resonating aperture within the end wall in said first resonating chamber and coupling said first resonating chamber to the area outside of said housing;

a second Helmholtz resonating aperture within the end wall in said second resonating chamber and coupling said second resonating chamber to the area outside of said housing;

said first chamber aperture and second chamber aperture set to resonate at slightly different frequencies to produce an additive output at frequencies between said slightly different frequencies.

55. An underwater sound transducer comprising:

a hollow cylindrical housing enclosing a volume including first and second resonating chambers;

ring shell transducer driver disposed within said housing and including two piezoelectric rings and a curved shell disposed between said rings and at least partially defining said resonating chambers, said curved shell having a first surface facing said first resonating chamber and a second surface facing said second resonating chamber;

a first cylindrical tube extension of a first length attached to one end of the housing;

a second cylindrical tube extension of a second length attached to the other end of the housing;

said first and second tube extensions set to resonate at slightly different frequencies to produce an additive output at frequencies between said slightly different frequencies.

56. An underwater sound transducer comprising:

a hollow cylindrical housing having two end walls and enclosing a volume including first and second resonating chambers;

a piezoelectric cylinder driver disposed between said first and second resonating chambers and at least partially defining said housing;

a quadrant ring insert disposed with said cylinder and including crossed rigid plates for attachment to said cylinder and four baffle caps, two of said baffle caps face said first resonating chamber and two of said baffle caps face said second resonating chamber, and wherein said quadrant ring insert drives aid cylinder into quadrant bending mode;

a first Helmholtz resonating aperture within the end wall in said first resonating chamber and coupling said first resonating chamber to the area outside of said housing;

a second Helmholtz resonating aperture within the end wall in said second resonating chamber and coupling said second resonating chamber to the area outside of said housing;

said first chamber aperture and second chamber aperture set to resonate at slightly different frequencies to produce an additive output at frequencies between said slightly different frequencies.

57. An underwater sound transducer comprising:

a hollow cylindrical housing having two end walls and enclosing a volume including six resonating chambers;

a free bender bar driver disposed lengthwise within said housing and contacting and at least partially defining each of said six resonating chambers;

two sets of baffles disposed within said housing which further define said resonating chambers and which retain said bender bar;

a plurality of Helmholtz resonating apertures, at least one aperture within each of said resonating chambers, wherein said apertures couple said chambers to the area outside of said housing.

* * * * *